US011129476B2

(12) United States Patent
Loveday

(10) Patent No.: US 11,129,476 B2
(45) Date of Patent: Sep. 28, 2021

(54) WRITING BOARD HOLDER

(71) Applicant: Scott Loveday, Golden Grove (AU)

(72) Inventor: Scott Loveday, Golden Grove (AU)

( * ) Notice: Subject to any disclaimer, the term of this patent is extended or adjusted under 35 U.S.C. 154(b) by 97 days.

(21) Appl. No.: 16/595,853

(22) Filed: Oct. 8, 2019

(65) Prior Publication Data

US 2020/0107638 A1 Apr. 9, 2020

(30) Foreign Application Priority Data

Oct. 8, 2018 (AU) ..... 2018903797

(51) Int. Cl.

| | |
|---|---|
| ***A47B 97/04*** | (2006.01) |
| ***B43K 23/00*** | (2006.01) |
| ***B43L 19/00*** | (2006.01) |
| ***B43L 1/10*** | (2006.01) |
| ***B41M 5/00*** | (2006.01) |
| *B43L 21/04* | (2006.01) |

(52) U.S. Cl.

CPC ..... *A47B 97/04* (2013.01); *B43K 23/001* (2013.01); *B43L 1/10* (2013.01); *B43L 19/0056* (2013.01); *B43L 21/04* (2013.01)

(58) Field of Classification Search

CPC ..... A47B 97/04; B43K 23/001; B43L 1/10; B43L 19/0056; B43L 21/04; B43L 21/06

See application file for complete search history.

(56) References Cited

U.S. PATENT DOCUMENTS

| | | | | | |
|---|---|---|---|---|---|
| 392,565 | A * | 11/1888 | Larew | | |
| 571,068 | A * | 11/1896 | Fillebrouwn | | |
| 1,002,260 | A * | 9/1911 | Golden | B61L 5/125 | 246/477 |
| 1,083,764 | A * | 1/1914 | Smith | A47B 23/007 | 248/445 |
| 4,558,522 | A * | 12/1985 | Lance | B43L 15/00 | 33/443 |
| 5,786,833 | A * | 7/1998 | Naka | B41J 2/14274 | 310/330 |
| 6,015,129 | A * | 1/2000 | Harrigan | A47B 23/043 | 248/444 |
| 7,546,996 | B2 * | 6/2009 | Somji | F16M 11/045 | 248/229.14 |
| 7,568,915 | B1 * | 8/2009 | Lavoie | B43L 1/00 | 434/408 |
| 7,644,927 | B2 * | 1/2010 | Law | F41J 1/10 | 273/407 |
| 2007/0069102 | A1 * | 3/2007 | Kane | A47B 23/042 | 248/444 |

* cited by examiner

*Primary Examiner* — Tan Le

(74) *Attorney, Agent, or Firm* — Sand, Sebolt & Wernow Co., LPA

(57) ABSTRACT

A writing board holder adapted for use with various writing boards and writing implements, incorporating a design attractive to children for interactive play. The writing board holder comprises at least one support post with an attached writing board, and appendages which can be used with writing and erasing implements to draw on the board and clean the board.

6 Claims, 6 Drawing Sheets

WRITING BOARD HOLDER

FIELD OF THE INVENTION

The present invention relates to a writing board holder incorporating a character design and interactive appendages.

BACKGROUND

Writing boards can refer to any surface upon which a user can write or draw and make non-permanent markings which can then be removed with an eraser or other wiping material. For example, chalk on a blackboard or erasable marker on a whiteboard, although other such terms to refer to the same or similar products can include marker board, dry erase board, wipe board, or chalk board. Such boards are a fixture of environments such as offices, school classrooms, playgrounds, and even in the home.

Such boards are particularly popular with children as they allow writing and drawing to be made on the board and then erased, allowing for multiple and prolonged use. The difficulty in use of such boards in a home environment or public area such as a playground is the mounting of the board in an accessible location, and avoiding removal and loss of the writing implements and eraser. Writing board holders commonly take the form of easels or other simple mounting devices, however it would be advantageous for the holder to incorporate a character design and other attractive and interactive features.

The object of this invention is therefore to provide an improved writing board and holder.

SUMMARY

In a first aspect the invention comprises a writing board holder comprising at least one pole and a first and second appendage attached to the pole, wherein a writing board is attached to the pole, the first appendage can be used with writing implement to mark the board, and the second appendage incorporates an eraser to remove marks from the board.

In preference the holder includes a second pole and the board is supported between the poles.

In preference the poles are attached to a base.

In preference the pole has a mounted piece and the holder incorporates a character design wherein the mounted piece represents a head, the pole represents a body, the first appendage represents an arm and hand, and the second appendage represents a leg and foot.

In preference the hand contains an aperture for the insertion of a writing implement, allowing the user to write on the board using the arm and hand.

In preference an eraser is attached to the foot, allowing the user to clean the board using the leg and foot.

In preference the writing board is replaceable.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION

Figure 1:
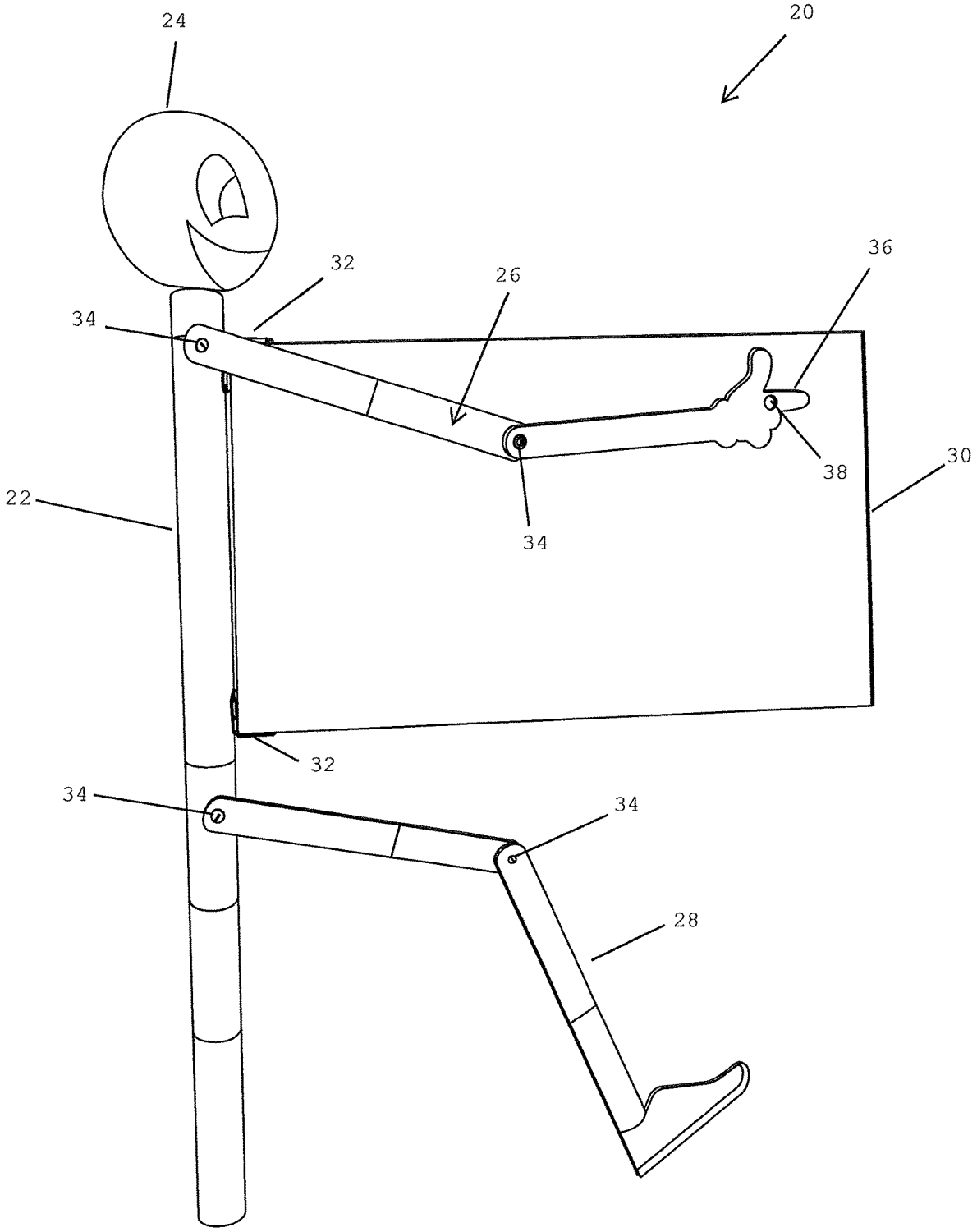
FIG. 1 is a perspective view of a writing board holder with two appendages and attached writing board.

The following detailed description of the invention refers to the accompanying drawings. Wherever possible, the same reference numbers will be used throughout the drawings and the following description to refer to the same and like parts. Dimensions of certain parts shown in the drawings may have been modified and/or exaggerated for the purposes of clarity or illustration.

The present invention relates to a writing board holder incorporating a character design with appendages allowing for interactive use when writing, drawing, and erasing. It is to be understood that the invention as illustrated in the drawings is an embodiment only, and other character designs can be used.

Turning now to the drawings there is illustrated in FIG. 1 a writing board holder 20 comprising a pole 22, mounted head 24, and first and second appendages 26 and 28. A writing board 30 is attached to the pole 22 by brackets 32. Accordingly, the writing board holder 20 incorporates a character design wherein the pole 22 is the body, the mounted head 24 is the head, and the appendages 26 and 28 are the respective legs and arms of the character. The holder is painted to further illustrate the appearance of the character, attracting the attention of the user and increasing the enjoyment of the activity above that of using a standard writing board.

The first appendage 26 is attached to the pole 22 at one end, preferably at "shoulder height" of the character to give the appearance of a humanoid arm attached to a body. The first appendage can be attached via known fastening means such as a bolt or screw 34, which when fastened is tight enough to secure the first appendage 26 to the pole 22, but still allows for rotational movement of the first appendage 26 relative to the pole 22.

In the present embodiment, the first appendage 26 is formed from two pieces, one representing the upper arm of the character above the elbow and the other the forearm of the character below the elbow. The respective pieces are secured by a bolt 34 to allow for rotational movement of the forearm relative to the upper arm. Accordingly, the first appendage 26 can either lay flush against the pole 22 when the holder 20 is not in use, however allows for movement similar to that of a human arm over and across the writing board 30 as illustrated in FIG. 1.

The forearm of the first appendage 26 incorporates a humanoid hand 36, which in the present embodiment has the shape of an erect thumb and extended pointer finger, with the remaining fingers clasped, colloquially known as a "finger gun" gesture, however it is to be understood that other hand shapes or gestures could be used in the representation of the character.

Figure 2:
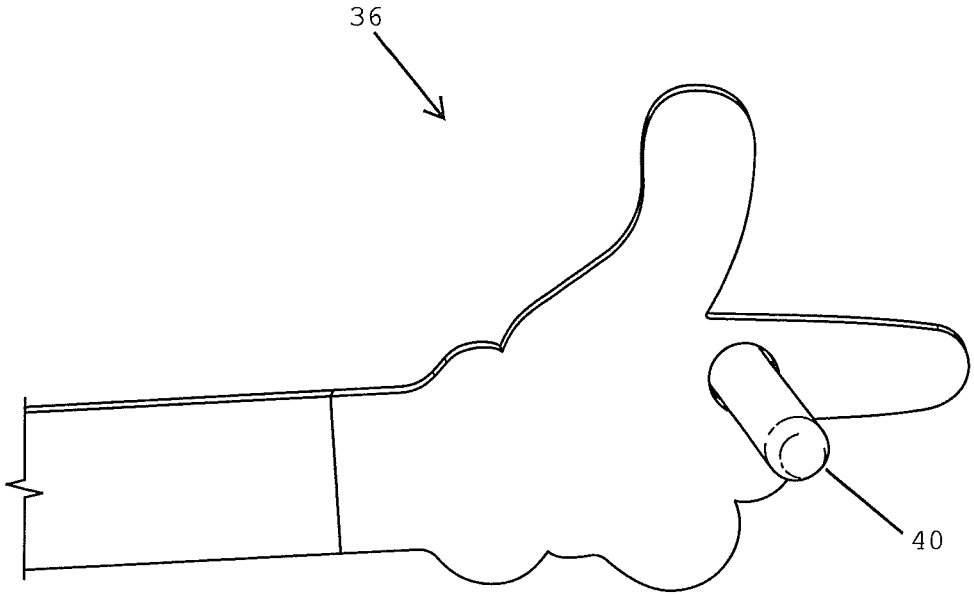
FIG. 2 is a perspective view of a hand appendage with attached writing implement.

The hand 36 also contains an aperture 38 allowing for the insertion of a writing implement, for example chalk 40 for use with a blackboard as illustrated in FIG. 2. It is to be understood that the writing implement is interchangeable, as is the writing board, and certain writing implements are appropriate for different kinds of writing boards. For example, if a whiteboard is used, the writing implement would likely be a whiteboard marker.

The writing implement is inserted through the aperture 38 and accordingly the user can write or draw on the board 30 through movement or manipulation of the first appendage. The first appendage 26 is of a length to ensure that the hand 36 can reach over the length and width of the board and accordingly the user can write or draw anywhere on the board.

Accordingly, writing or drawing on the board 30 is interactive for the user, particularly children who can pretend that it is the character drawing on the board and increase enjoyment of the activity.

Figure 3:
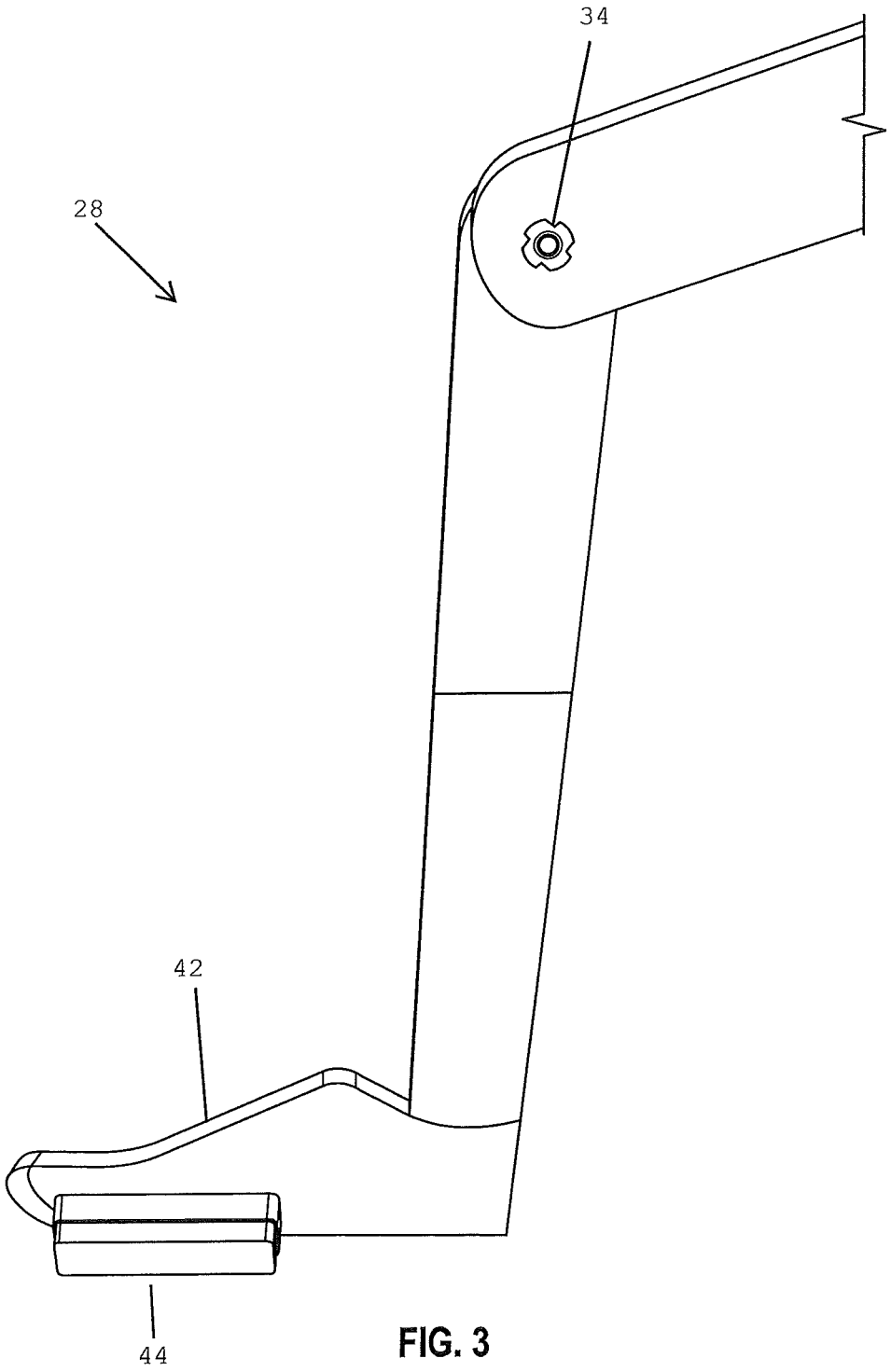
FIG. 3 a perspective view of a leg appendage with attached eraser.

As illustrated in FIG. 3, the second appendage 28 is formed from two pieces, one representing the upper leg of the character above the knee, and the other representing the lower leg of the character below the knee. The respective pieces are secures by a bolt 34 to allow for rotational movement of the lower leg relative to the upper leg. Accordingly, the second appendage can either lay flush against the pole 22 or resting against the ground when not in use, however allows for movement similar to that of a human leg.

The lower leg of the second appendage 28 incorporates a humanoid foot 42, which in the present embodiment has the shape of a shoe. An eraser 44 is attached to the foot 42 for the purpose of wiping or cleaning the board 30. It is to be understood that the eraser 44 is interchangeable to allow for the appropriate eraser to be applied to the respective writing board, for example a blackboard eraser for a blackboard and a whiteboard eraser for a whiteboard, given that the materials for erasing chalk and whiteboard markers may differ.

The second appendage 28 is of a length to ensure that the foot 42 can reach over the length and width of the board and accordingly the user can erase markings from anywhere on the board.

Preferable the eraser 44 is fixed to the foot 42 to prevent loss of the eraser 44, however it is to be understood that the eraser 44 can be interchangeable to allow for use of the holder 20 with different kinds of boards and respective erasers.

The user can move or manipulate the second appendage 28 to clean the board 30 by erasing the markings mad by the writing implement. Accordingly, cleaning the board is interactive for the user, particularly children who can pretend it is the character performing this function, and increasing enjoyment of the activity.

Accordingly, the user can write on the board with the first appendage 26, and erase the board with the second appendage 28, making the overall activity interactive and enjoyable for the user.

It is to be understood that while the character depicted in the drawings is humanoid, any character or embodiment can be used to the same effect. For example, instead of a humanoid, the character could take the form of a plant, wherein the pole 22 is a stem, the head 24 is a flower, and the appendages leaves or branches. Other character examples include animals such as a cat, dog, monkey, etc.

Figure 4:
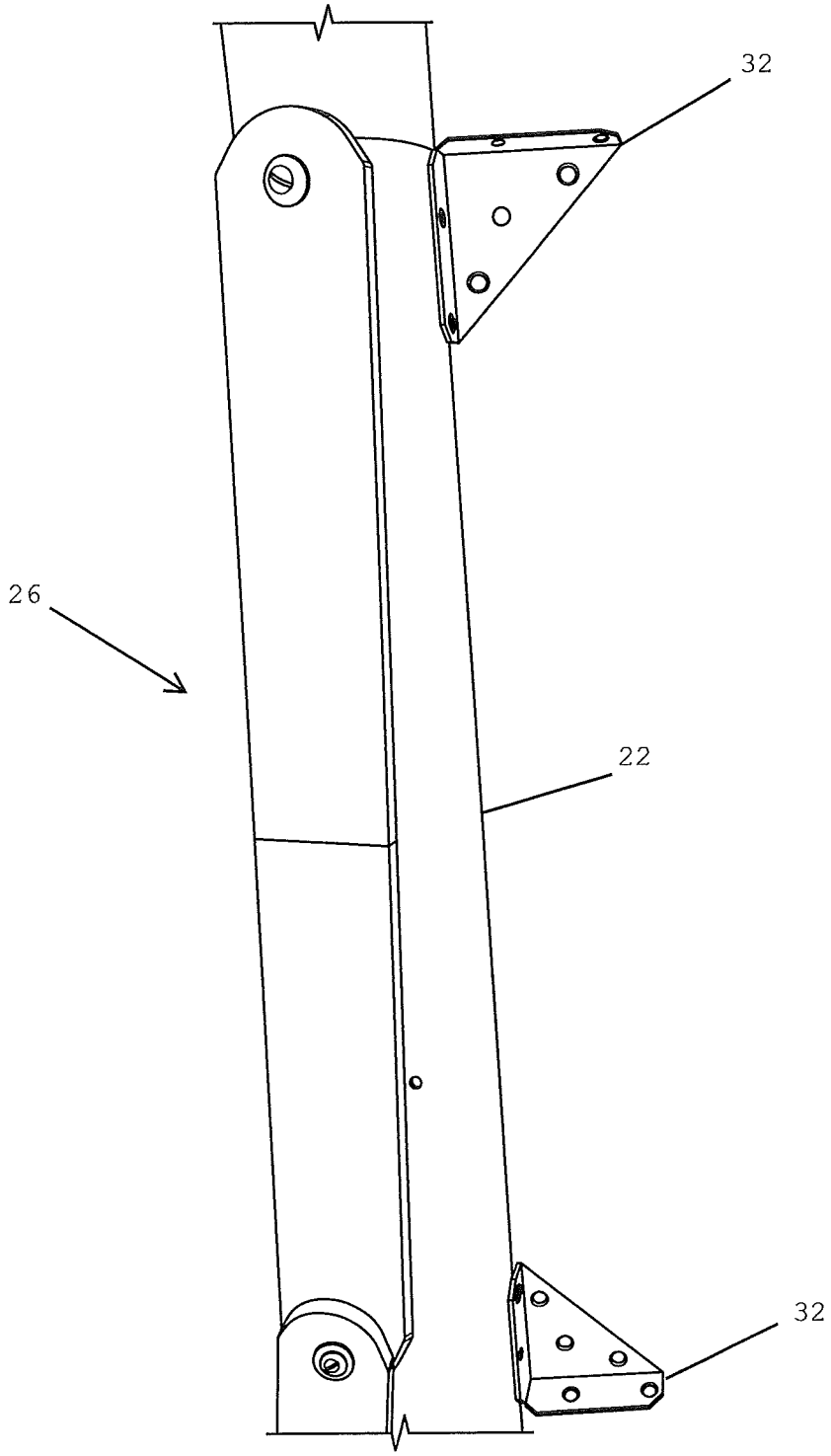
FIG. 4 a perspective view of the central portion of a writing board holder with brackets.

Preferably, the writing board 30 is attached to the pole 22 by brackets 32 fixed to the pole 22 between the first and second appendages 26 and 28 using screws. Illustrated in FIG. 4 are the brackets 32 attached to the pole 22, with the first appendage 26 laying flush against the pole 22. Preferably the board 30 is fixed to the pole 22 to prevent movement or removal by children, however can be unscrewed and removed by an adult allowing for the holder to be interchangeably used with different writing boards.

Figure 5:
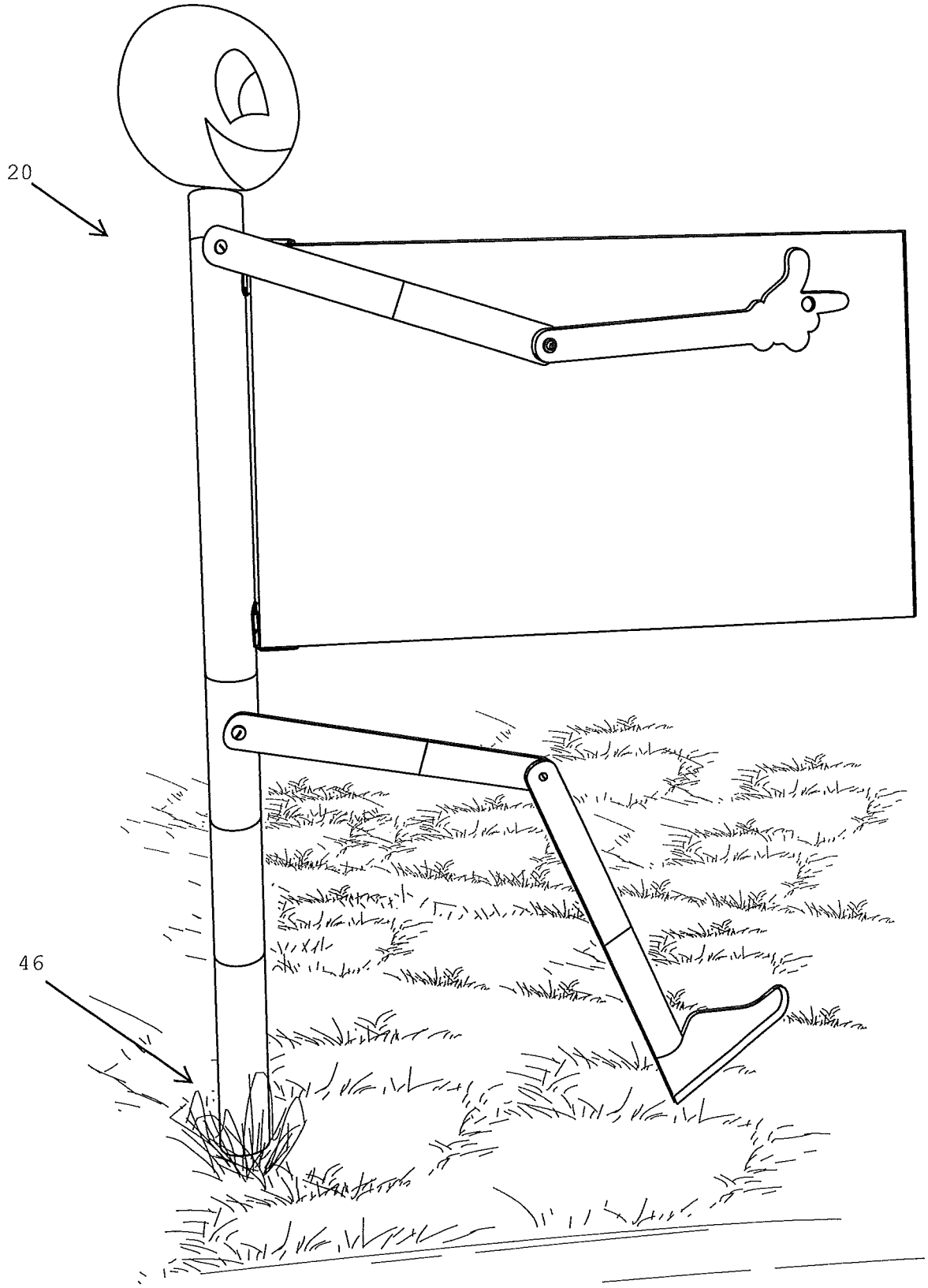
FIG. 5 a perspective view of a writing board holder with two appendages and attached writing board as fixed into the ground.

The pole 22 can be inserted into the ground, fixing the holder 20 in place allowing for safe use by children as illustrated in FIG. 5. Accordingly the invention is suited to use in various locations, such as playgrounds, child care centres, schools and the home. The character design attracts the attention of children over and above that of a simple writing board, and through manipulation of the appendages allows for interaction of the character into writing or drawing on the board, and cleaning the board with an eraser.

Figure 6:
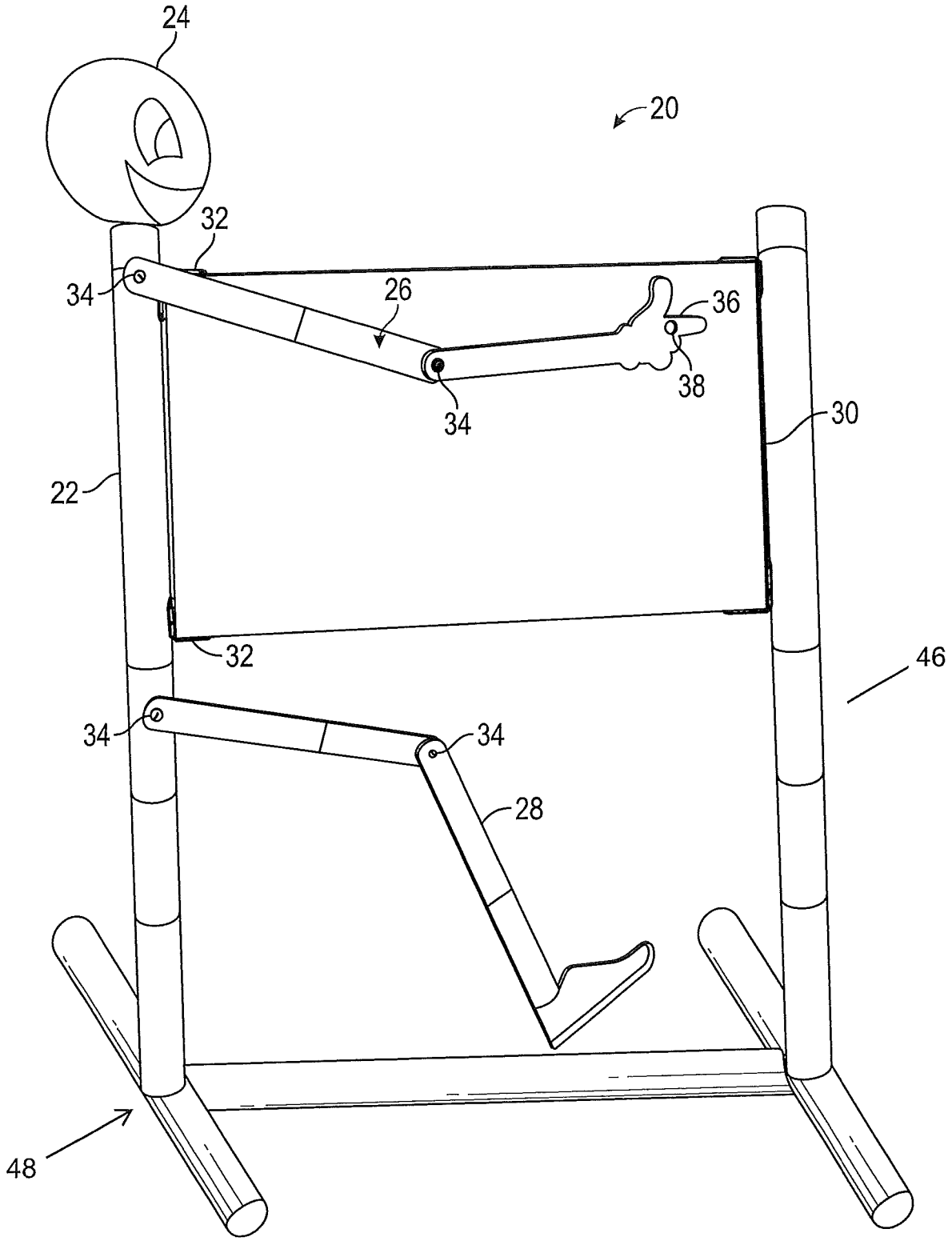
FIG. 6 is a perspective view of a second embodiment writing board holder with two appendages, a writing board fixed between two poles, and a base.

Illustrated in FIG. 6 is a second embodiment of the invention wherein the writing board holder 22 includes a support pole 46 and support base 48. The support pole 46 is parallel to the primary pole 22, and the writing board 30 is supported between the two. Use of the support pole 46 allows for additional strength and support to the writing board 30, and also helps prevents bending or breaking of the board.

The support pole can be incorporated into the character design or form another design element, for example having the appearance of a pencil or rocket ship. It is to be understood that the support pole 46 can also be used with the first embodiment of the invention.

In the second embodiment of the invention the writing board holder 20 also includes a base 48 which allows the holder to be freestanding and easily moveable. The base is preferably two parallel members connected by a cross member to form an H frame. The parallel members are attached to the cross member by brackets or other attachment means. The primary pole 22 and support pole 46 are connected to the base 48 by a bolt or other attachment means, and held securely allowing the writing board holder 20 to rest flat against the surface of the ground. This allows use of the holder on any relatively flat surface, such as a backyard, playground surface, or inside the home. It also allows for the holder to be moved from location to location as required.

Accordingly, the first embodiment of the invention is best suited to locations where the holder is best used fixed, such as public playgrounds, schools, child care centres and the like where insertion into the ground to prevent movement, removal and damage is appropriate. The second embodiment of the invention is best suited to locations where the holder may need to be moved on a regular basis, such as the home or for indoor use in schools and child care centres.

The base 48 can also include further support means (not shown), for example in the form of semi-circles attached to the poles and parallel members, wherein the straight side of the semi-circle is in line with the member and attached via a bolt or other connection means, and the arc of the semi-circle traverses the pole, and is attached to the pole via a bolt or other connecting means.

The base can be incorporated into the character design or form another design element. For example, the base can be painted different colours, and the semi-circles can include designs such as rainbows.

It is to be understood that the writing board holder 20 can be of varying sizes depending on the purpose and intended use.

The reader will now appreciate the present invention which is a writing board holder adapted for use with various writing boards and writing implements, incorporating a character design attractive to children for interactive play.

LIST OF COMPONENTS

20 writing board holder
22 pole
24 head
26 first appendage
28 second appendage
30 writing board
32 brackets
34 bolt
36 hand
38 aperture
40 chalk
42 foot
44 eraser
46 support pole
48 base Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus. Any discussion of the prior art throughout the specification should in no way be considered as an admission that such prior art is widely known or forms part of the common general knowledge in this field.

In the present specification and claims (if any), the word "comprising" and its derivatives including "comprises" and "comprise" include each of the stated integers but does not exclude the inclusion of one or more further integers.

The invention claimed is:

1. A writing board holder comprising:

at least one pole having a mounted piece; and a first appendage and a second appendage attached to the at least one pole;

wherein the at least one pole is adapted to secure a writing board thereto, the first appendage is adapted to be used with a writing implement to mark the writing board, and the second appendage is adapted to incorporate an eraser to remove marks from the writing board;

wherein the writing board holder incorporates a character design and, in the character design, the mounted piece of the at least one pole represents a head, the at least one pole represents a body, the first appendage represents an arm and a hand, and the second appendage represents a leg and a foot; and wherein the hand of the first appendage defines an aperture therein for the insertion of the writing implement, allowing a user to write on the writing board using the arm and the hand.

2. The writing board holder according to claim 1, wherein the at least one pole includes a first pole and a second pole, and wherein the writing board is supported between the first pole and the second pole.

3. The writing board holder according to claim 1, further comprising a base, and wherein the at least one pole is attached to the base.

4. The writing board holder according to claim 1, wherein the eraser is attached to the foot of the second appendage, allowing the user to clean the writing board using the leg and the foot.

5. The writing board holder according to claim 1, wherein the writing board is replaceable.

6. The writing board holder according to claim 1, wherein the at least one pole is inserted into the ground to fix the writing board holder in place.

* * * * *